US012637825B2

(12) United States Patent
Rainey

(10) Patent No.: US 12,637,825 B2
(45) Date of Patent: May 26, 2026

(54) MECHANICALLY STABILIZED EARTH (MSE) RETAINING WALL EMPLOYING REINFORCEMENT RODS

(71) Applicant: Earth Wall Products, LLC, Smyrna, GA (US)

(72) Inventor: Thomas L. Rainey, Marietta, GA (US)

(73) Assignee: EARTH WALL PRODUCTS, LLC, Smyrna, GA (US)

( * ) Notice: Subject to any disclaimer, the term of this patent is extended or adjusted under 35 U.S.C. 154(b) by 99 days.

(21) Appl. No.: 18/640,773

(22) Filed: Apr. 19, 2024

(65) Prior Publication Data

US 2025/0327263 A1 Oct. 23, 2025

(51) Int. Cl.
*E02D 29/02* (2006.01)

(52) U.S. Cl.
CPC ..... *E02D 29/0233* (2013.01); *E02D 29/0266* (2013.01); *E02D 2300/002* (2013.01); *E02D 2300/0034* (2013.01); *E02D 2600/20* (2013.01); *E02D 2600/30* (2013.01)

(58) Field of Classification Search
CPC ..... E02D 29/0225; E02D 29/0233; E02D 29/0266; E02D 29/0258
See application file for complete search history.

(56) References Cited

U.S. PATENT DOCUMENTS 2,110,253 A * 3/1938 Nedden ..... E02D 29/02 405/262
4,154,554 A 5/1979 Hilfiker
4,260,296 A * 4/1981 Hilfiker ..... E02D 29/025 405/287
4,266,890 A * 5/1981 Hilfiker ..... E02D 29/0266 405/262
4,514,113 A * 4/1985 Neumann ..... E02D 29/0233 405/262
5,002,436 A * 3/1991 Sigourney ..... E02D 29/0266 405/262
5,525,014 A * 6/1996 Brown ..... E02D 29/0241 405/262
5,533,839 A * 7/1996 Shimada ..... E02D 29/0233 405/286
6,050,748 A 4/2000 Anderson
6,079,908 A * 6/2000 Anderson ..... E02D 29/02 405/262

(Continued)

FOREIGN PATENT DOCUMENTS

CN 1124806 A * 6/1996 ..... E02D 29/0241

OTHER PUBLICATIONS

European Search Report in related EP Application No. 25171507, mailed Sep. 24, 2025.

*Primary Examiner* — Frederick L Lagman
(74) *Attorney, Agent, or Firm* — Thomas | Horstemeyer, LLP

(57) ABSTRACT

Disclosed are embodiments of a mechanically stabilized earth (MSE) retaining wall that employs one or more reinforcement rods and that can be produced with inexpensive, widely available parts. A concrete panel is provided. A steel embed is provided with a loop and with first and second outwardly extending stems. The loop is secured within the concrete panel. A steel reinforcement rod is provided within backfill soil. A connector plate is welded at one end to the rod and is secured at another end to the stems via a fastener, such as a bolt and nut.

15 Claims, 4 Drawing Sheets

(56) References Cited

U.S. PATENT DOCUMENTS

| | | | | |
|---|---|---|---|---|
| 6,371,699 | B1 * | 4/2002 | Weinreb | E02D 29/0241 405/262 |
| 8,079,782 | B1 * | 12/2011 | Hilfiker | E02D 29/0233 405/262 |
| 8,632,277 | B2 | 1/2014 | Taylor | |
| 8,979,437 | B2 * | 3/2015 | Freitag | E04C 5/12 405/262 |
| 9,605,402 | B2 * | 3/2017 | Taylor | E02D 29/0233 |
| 10,577,772 | B1 * | 3/2020 | Taylor | E02D 5/801 |
| 11,519,151 | B2 * | 12/2022 | Taylor | E02D 29/0233 |
| 12,252,859 | B2 * | 3/2025 | Rainey | E02D 29/0266 |
| 2010/0247248 | A1 * | 9/2010 | Taylor | E02D 5/76 405/262 |
| 2011/0229274 | A1 * | 9/2011 | Taylor | B23K 11/002 405/262 |
| 2022/0064895 | A1 * | 3/2022 | Taylor | B21D 53/00 |
| 2024/0401298 | A1 * | 12/2024 | Rainey | E02D 29/0266 |

* cited by examiner

MECHANICALLY STABILIZED EARTH (MSE) RETAINING WALL EMPLOYING REINFORCEMENT RODS

FIELD OF THE INVENTION

The present invention generally relates to modular earth retaining walls, and more particularly, to mechanically stabilized earth (MSE) retaining walls.

BACKGROUND OF THE INVENTION

Modular earth retaining walls with concrete panels are commonly used for architectural and site development applications. Such walls are subjected to very high pressures exerted by lateral movements of the soil, temperature and shrinkage effects, and seismic loads.

In many commercial applications, for example, along or supporting highways, etc., each concrete panel can weigh between two and five thousand pounds and have a front elevational size of about eight feet in width by about five feet four inches in height.

Oftentimes, the earth retaining walls of this type are reinforced. More specifically, a conventional mechanically stabilized earth (MSE) retaining wall with steel reinforcement is typically reinforced with steel strips or welded wire meshes that extends backward, or perpendicular, from the rear of a concrete panel to reinforce the backfill soil.

The inventor of the present application filed a patent application Ser. No. 17/380,697 on Jul. 20, 2023, with a design for an MSE retaining wall with reinforcement rods having spaced pullout inhibiting structures (e.g., round planar disks), which application is incorporated herein by reference in its entirely. Although this design tested well in field tests and had significant merit, it undesirably employed specially made parts that resulted in high cost as well as difficulty in terms of installation.

Some of the significant challenges in this field of design are the cost and design complexity that oftentimes requires specially made parts that are not readily available and/or expensive. That is the focus of the present disclosure.

SUMMARY OF THE INVENTION

The present disclosure provides various embodiments of an inexpensive and effective mechanically stabilized earth (MSE) retaining wall that employ, for reinforcement, cylindrical rods.

One embodiment, among others, can be summarized as follows. A concrete panel is provided. A steel embed is provided with a loop and with first and second outwardly extending stems. The loop is secured within the concrete panel. A steel reinforcement rod is provided within backfill soil. A connector plate is welded at one end to the rod and is secured at another end to the stems via a fastener, for example, a bolt with nut arrangement.

Other embodiments, apparatus, systems, methods, features, and advantages of the present disclosure will be or become apparent to one with skill in the art upon examination of the following drawings and detailed description. It is intended that all such additional embodiments, apparatus, systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. The dimensions indicated in some of the figures are associated with a nonlimiting examples of an embodiment.

DETAILED DESCRIPTION OF PREFERRED EMBODIMENTS

Figure 1:
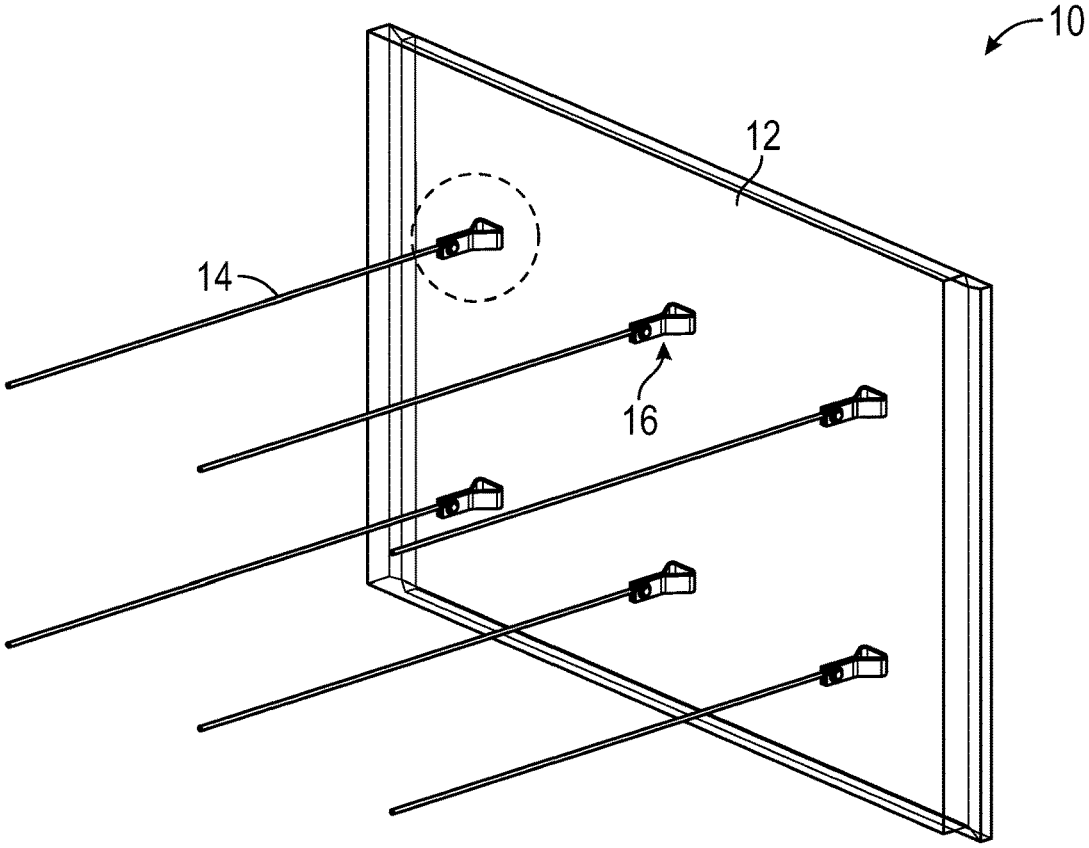
FIG. 1 is a perspective view of a mechanically stabilized earth (MSE) retaining wall employing one or more wall panels and one or more reinforcement rods in accordance with the present invention.
Figure 2:
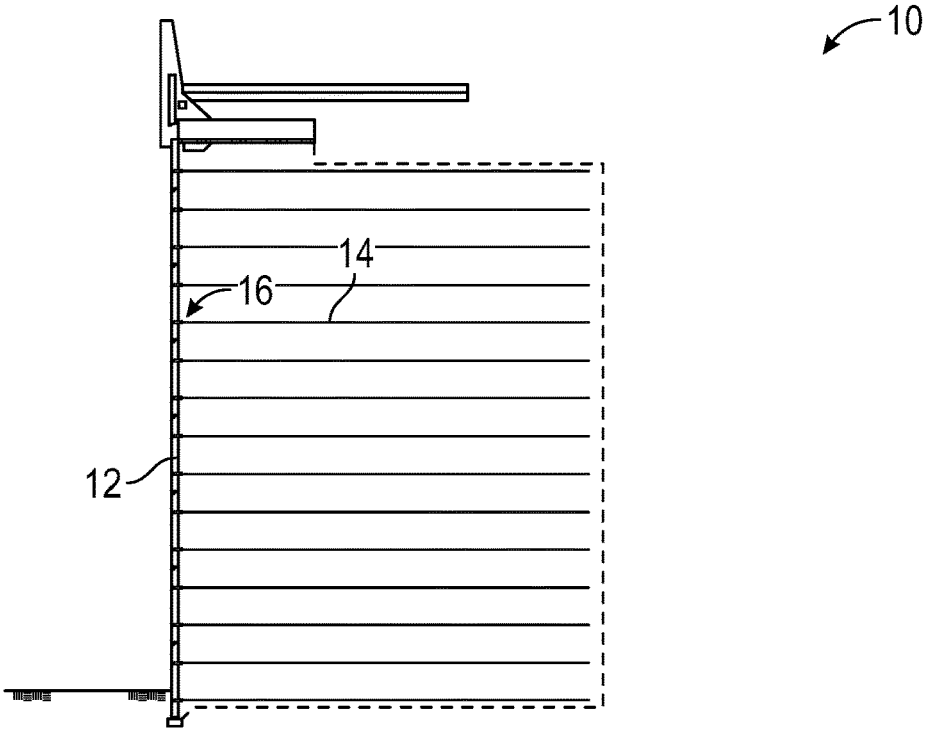
FIG. 2 is a side cross sectional view of the wall of FIG. 1.

FIGS. 1 and 2 show a mechanically stabilized earth (MSE) retaining wall 10 employing one or more modular concrete wall panels 12 and one or more elongated cylindrical steel reinforcement rods 14 in accordance with the present invention. The wall 10 can be produced with inexpensive, widely available parts and will have a lifespan of at least one hundred years, as is required by regulations in most governmental jurisdictions.

As illustrated, the concrete wall panel 12 has a generally planar body with a frontside, a backside, and a surrounding peripheral edge.

The reinforcement rod 14 has a longitudinal body with first and second ends with the first end residing within the backfill soil and the second end being secured within a wall panel 12. The second end is secured within the wall panel 12 when the wall panel 12 is cast, or formed. Although not required, each rod 14 preferably comprises raised ribs along its longitudinal body. In the preferred embodiment, each rod 14 is standard rebar, which is inexpensive and widely available.

Figure 3A:
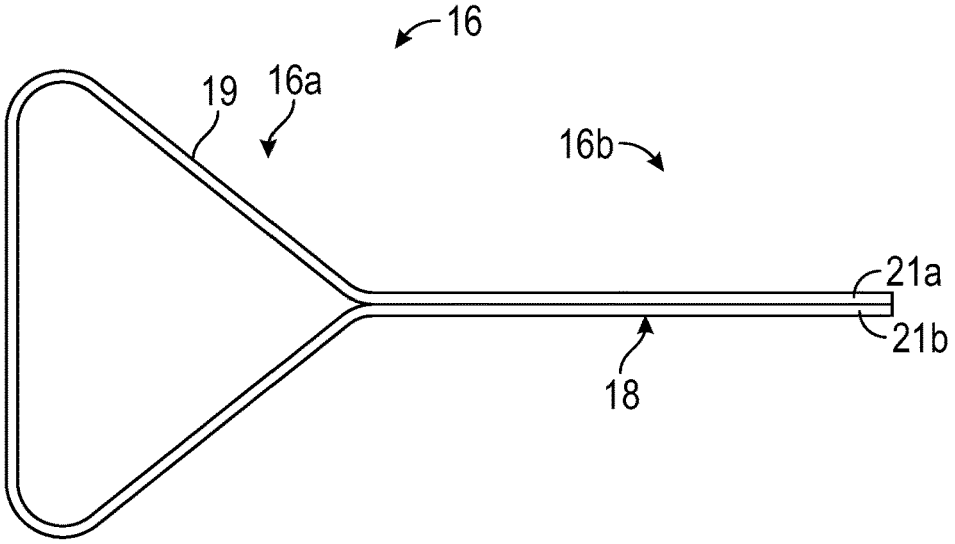
FIG. 3A is a side view of a widely available embed of FIG. 1 designed to attach a wall panel of the wall to a reinforcement rod.
Figure 3B:
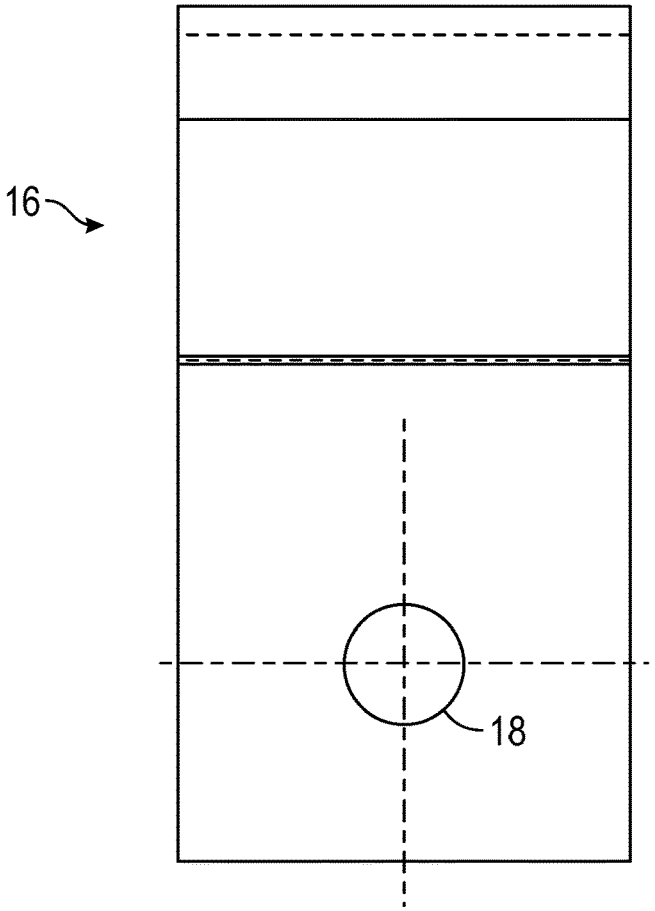
FIG. 3B is a top view of the embed of FIG. 3A.

As shown in FIGS. 3A and 3B, a steel embed 16 is used to connect the panel 12 to a reinforcement rod 14. Each embed 16 has interconnected first and second parts 16*a*, 16*b*. The first part 16*a* is secured to and within the concrete panel 12. The second part 16*b* extends outwardly from the backside of the wall panel 12. The second part 16*b* has an aperture 18, which is preferably although not necessarily circular. The aperture 18 has a central axis that extends generally parallel to the backside of the panel 12.

In the preferred embodiment, the first part 16*a* of the embed 16 is a triangular-shaped steel loop 19, and the second part 16*b* comprises first and second stems 21*a*, 21*b* secured to and extending in a linear manner outwardly from the steel loop 19. Each of the stems 21*a*, 21*b* has opposing first and second generally flat sides extending between first and second edges and having the circular aperture 18. The first side of the first stem 21*a* being contiguous with the second side of the second stem 21*b*. Moreover, the circular apertures 18 of the stems 21*a*, 21*b* are substantially aligned with each other. Furthermore, because the first and second stems 21*a*, 21*b* a contiguous (with no separation), no concrete gets in between them when concrete is poured to cast the panel 12.

In this preferred embodiment, the loop 19 and stems 21*a*, 21*b* are formed from a singular elongated steel plate having opposing first and second generally flat sides extending between left and right edges and first and second ends, the loop being triangular in shape, the first and second stems formed by respective longitudinal parts near the first and second ends of the steel plate. The widely available embed 16 is machine produced in mass and readily available for flat plate steel strips and/or welded wire mesh, which are commonly used with MSE wall structures. The current invention involves the unique method of attaching the common, machine produced embed to an unconventional round reinforcement rod 14.

Figure 4:
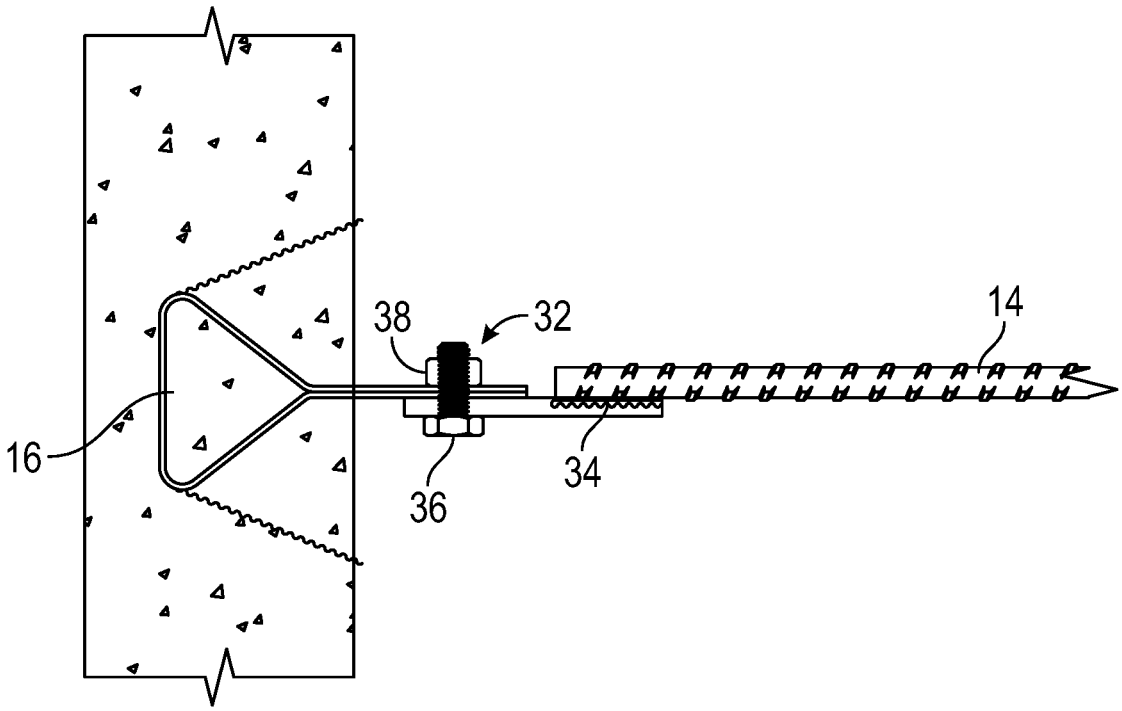
FIG. 4 is s side view of the connection system of the present disclosure.
Figure 5:
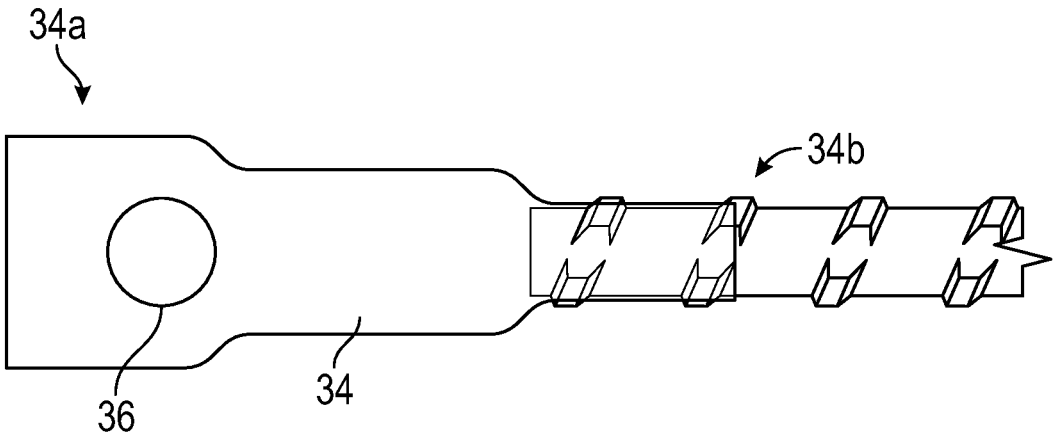
FIG. 5 is a view of the connector plate of FIG. 4.

FIGS. 4 and 5 illustrate a connection system 32 of the present disclosure. The connection system 32 is designed to secure together the embed 16 and the reinforcement rod 14. The connection system 32 includes a connector plate 34 having a generally flat elongated body with first and second opposing, generally parallel, surfaces extending between first and second ends 34*a*, 34*b*. The elongated body is a suitable width for the strength requirements. The flat elongated body of the connector plate 34 has three regions: a first region 35*a* having a first width, a second region 35*b* having a second width that is greater than the first width of the first region 35*a*, and a third region 35*c* having a third width that is greater than the second width of the second regio 35*bn*.

The connector plate 34 has an aperture 36 in the third region 35*c* at or near the first end 34*a*. The aperture 36 is preferably although not necessarily circular. The plate aperture 36 is generally aligned with the connector aperture 18. The second end 34*b* of the plate 34 is secured to the end of the reinforcement rod 14, preferably although not necessarily via a weldment.

A fastener 36 extends through the apertures 18, 36 to thereby secure together the connector plate 34 and the embed 16. In the preferred embodiment, the fastener 36 is a threaded steel bolt with a threaded elongated body, a head, and a distal end that receives a threaded steel nut 38.

Figure 6:
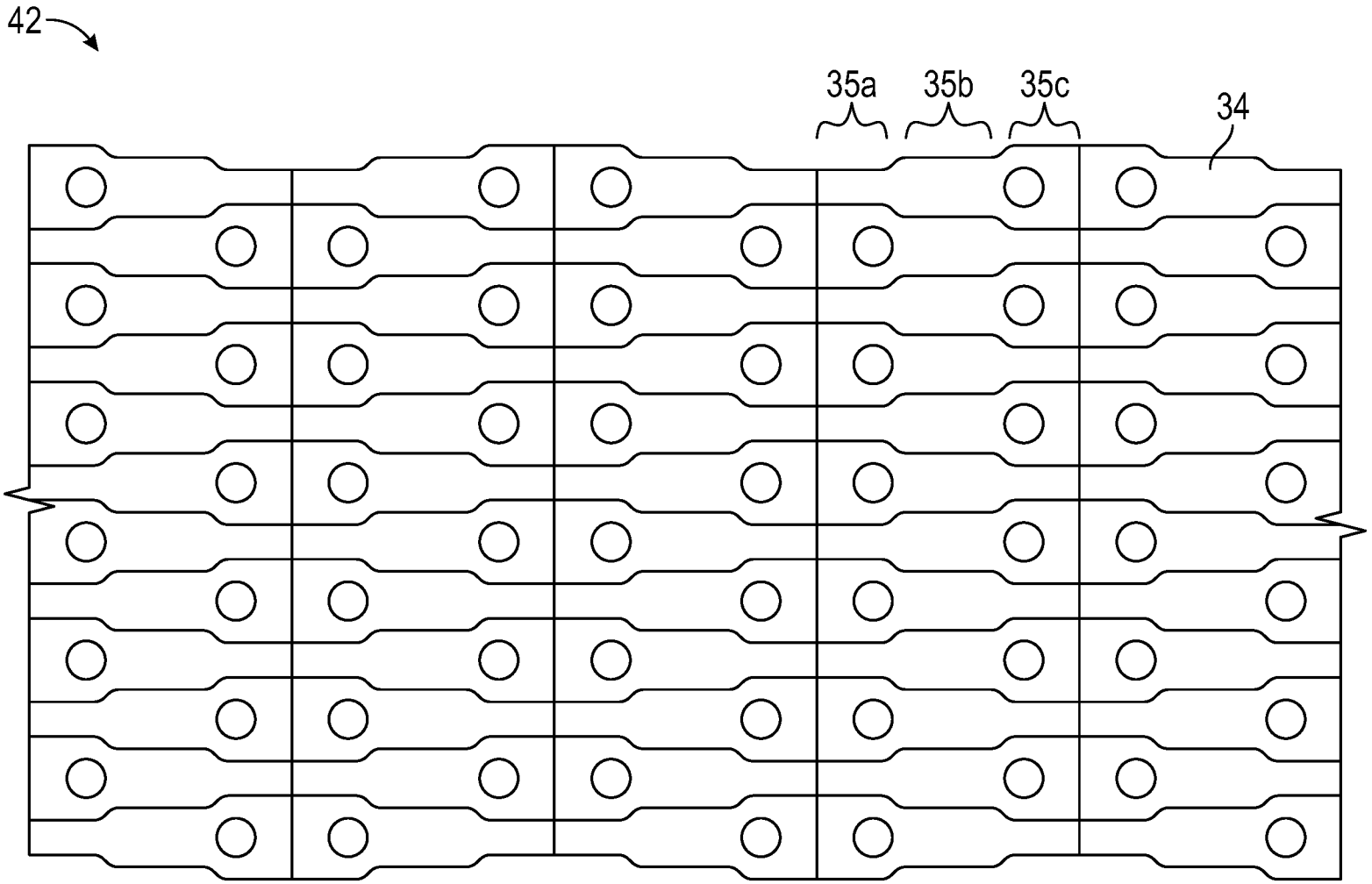
FIG. 6 is a view of the manufacturing layout for the connector plate of FIG. 5, showing how numerous plates can be made in an inexpensive manner from a flat piece of steel.

FIG. 6 is a view that shows how many plates 34 can be produced in an inexpensive manner from a flat sheet of steel. In the preferred embodiment, the steel sheet is ¼ inch in thickness, and the plates 34 are cut using a plasma cutter. As is clear from the layout 42 of the plates 34 in FIG. 5, use of the steel is maximized with little waste. The three different width regions 35*a*, 35*b*, 35*c* enables this efficient layout 42.

Finally, it should be emphasized that the above-described embodiment(s) of the present invention is merely a possible nonlimiting example of an implementation, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention.

As an example of an alternative embodiment, the apertures 18 and 36 could be octagonal, square, etc.

As another example of an alternative embodiment, the embed 16 may have only a single stem extending from the loop 19.

As yet another example of an alternative embodiment, the loop 19 of the embed 16 could have a different shape, for example, T-shaped, circular, irregular, partial loop, linear, non-symmetrical, etc.

The invention claimed is:

1. A mechanically stabilized earth (MSE) retaining wall, the wall comprising:

a concrete panel, the panel having a generally planar body with a frontside, a backside, and a surrounding peripheral edge;

a steel embed having first and second parts, the first part residing and secured within the concrete panel, the second part extending outwardly from the backside, the second part having an aperture;

a steel rebar rod, the rod having a generally cylindrical elongated body with first and second ends, the rebar rod having a plurality of raised ribs along its elongated body, the first end residing within backfill soil;

a steel connector plate having a generally flat elongated body with first and second opposing surfaces extending between first and second ends, the plate having an aperture in the first end, the plate aperture being aligned with the embed aperture, the second end being secured to the second end of the rebar rod; and a steel fastener extending through the apertures to thereby secure together the connector plate and the embed.

2. The wall of claim 1, wherein the fastener is a steel threaded bolt having a generally cylindrical elongated body with first and second ends, the first end having a bolt head, the second end having a steel bolt nut that is threaded thereon.

3. The wall of claim 1, wherein the connector plate is welded to the rebar rod.

4. The wall of claim 1, wherein the embed aperture has a central axis that extends generally parallel to the backside of the panel.

5. The wall of claim 1, wherein the first part of the embed is a steel loop and the second part comprises first and second stems secured to and extending in a linear manner outwardly from the steel loop, each of the stems having opposing first and second generally flat sides extending between first and second edges and having first and second apertures, the first side of the first stem being contiguous with the second side of the second stem, the apertures being substantially aligned to create the aperture.

6. The wall of claim 1, wherein the flat elongated body of the connector plate has three regions, a first region having a first width, a second region having a second width that is greater than the first width of the first region, and a third region having a third width that is greater than the second width of the second region, and wherein the connector plate aperture resides within the third region.

7. A system for connecting a concrete panel associated with a mechanically stabilized earth (MSE) retaining wall with a steel rebar rod that extends into backfill soil, the rebar rod having a plurality of raised ribs along its elongated body, the system comprising:

a steel embed having first and second parts, the first part residing and secured within the concrete panel, the second part extending outwardly from the backside, the second part having an aperture;

a steel connector plate having a generally flat elongated body with first and second opposing surfaces extending between first and second ends, the plate having an aperture in the first end, the plate aperture being aligned with the embed aperture, the second end being secured to the rebar rod; and a steel fastener extending through the apertures to thereby secure together the connector plate and the embed.

8. The system of claim 7, wherein the fastener is a steel threaded bolt having a generally cylindrical elongated body with first and second ends, the first end having a bolt head, the second end having a steel bolt nut that is threaded thereon.

9. The system of claim 7, wherein the connector plate is welded to the rebar rod.

10. The system of claim 7, wherein the embed aperture has a central axis that extends generally parallel to the backside of the panel.

11. The system of claim 7, wherein the first part of the embed is a steel loop and the second part comprises first and second stems secured to and extending in a linear manner outwardly from the steel loop, each of the stems having opposing first and second generally flat sides extending between first and second edges and having first and second apertures, the first side of the first stem being contiguous with the second side of the second stem, the apertures being substantially aligned to create the aperture.

12. The system of claim 7, wherein the flat elongated body of the connector plate has three regions, a first region having a first width, a second region having a second width that is greater than the first width of the first region, and a third region having a third width that is greater than the second width of the second region, and wherein the connector plate aperture resides within the third region.

13. A mechanically stabilized earth (MSE) retaining wall comprising the system of claim 9.

14. A mechanically stabilized earth (MSE) retaining wall, the retaining wall comprising:

a concrete panel, the panel having a generally planar body with a frontside, a backside, and a surrounding peripheral edge;

a steel embed having first and second parts, the first part residing and secured within the concrete panel, the second part extending outwardly from the backside, the second part having an aperture;

a steel rebar rod, the rod having a generally cylindrical elongated body with first and second ends, the rebar rod having a plurality of raised ribs along its elongated body, the first end residing within backfill soil;

a steel connector plate having a generally flat elongated body with first and second opposing surfaces extending between first and second ends, the plate having an aperture in the first end, the plate aperture being aligned with the embed aperture, the second end being secured to the second end of the rebar rod;

a steel fastener extending through the apertures to thereby secure together the connector plate and the embed;

wherein the fastener is a steel threaded bolt having a generally cylindrical elongated body with first and second ends, the first end having a bolt head, the second end having a steel bolt nut that is threaded thereon;

wherein the embed aperture has a central axis that extends generally parallel to the backside of the panel;

wherein the connector plate is welded to the reinforcement rod; and wherein the first part of the embed is a steel loop and the second part comprises first and second stems secured to and extending in a linear manner outwardly from the steel loop, each of the stems having opposing first and second generally flat sides extending between first and second edges and having first and second apertures, the first side of the first stem being contiguous with the second side of the second stem, the apertures being substantially aligned to create the aperture.

15. The retaining wall of claim 14, wherein the flat elongated body of the connector plate has three regions, a first region having a first width, a second region having a second width that is greater than the first width of the first region, and a third region having a third width that is greater than the second width of the second region, and wherein the connector plate aperture resides within the third region.

* * * * *